US008427297B1

(12) United States Patent
Markey et al.

(10) Patent No.: US 8,427,297 B1
(45) Date of Patent: Apr. 23, 2013

(54) FACILITY EMERGENCY SYSTEMS AND METHODS

(75) Inventors: Michael Vincent Markey, Brackenridge, PA (US); Alphonse A. Santucci, Jr., Lower Burrell, PA (US); Michael J. Zampogna, II, Pittsburgh, PA (US)

(73) Assignee: Mikal3 LLC, Lower Burrell, PA (US)

( * ) Notice: Subject to any disclaimer, the term of this patent is extended or adjusted under 35 U.S.C. 154(b) by 411 days.

(21) Appl. No.: 12/765,153

(22) Filed: Apr. 22, 2010

(51) Int. Cl.
*G08B 29/00* (2006.01)

(52) U.S. Cl.
USPC ..... 340/506; 340/531; 340/3.1; 700/83; 700/19

(58) Field of Classification Search ..... 340/506, 340/531, 573.1, 3.1; 700/19, 83
See application file for complete search history.

(56) References Cited

U.S. PATENT DOCUMENTS

| | | | | |
|---|---|---|---|---|
| 6,624,750 | B1 | 9/2003 | Marman et al. | |
| 6,990,393 | B2 * | 1/2006 | Parker | 700/282 |
| 7,049,951 | B2 | 5/2006 | Rhodes et al. | |
| 7,123,142 | B2 | 10/2006 | Bohbot et al. | |
| 7,183,907 | B2 | 2/2007 | Simon et al. | |
| 7,271,704 | B2 | 9/2007 | McSheffrey et al. | |
| 7,391,319 | B1 | 6/2008 | Walker | |
| 7,460,020 | B2 * | 12/2008 | Reyes et al. | 340/573.1 |
| 2003/0117280 | A1 | 6/2003 | Prehn | |
| 2005/0091368 | A1 | 4/2005 | Ozburn | |
| 2006/0017547 | A1 * | 1/2006 | Buckingham et al. | 340/328 |
| 2007/0096872 | A1 * | 5/2007 | Nguyen et al. | 340/5.61 |
| 2007/0132844 | A1 * | 6/2007 | Katz | 348/140 |
| 2008/0238659 | A1 | 10/2008 | Houde et al. | |
| 2009/0160673 | A1 * | 6/2009 | Cirker | 340/825.69 |

OTHER PUBLICATIONS

Student Alert—Indoor & Outdoor Warning. ■ Alert With Tone, Communicate. www.whelen.com/pb/Mass%20Notification/.../Student_Alert.pdf, 2008.

Lanalarm, http://www.lanalarm.com/About.aspx, Aug. 31, 2009.

Autocomm Provides Visual Information and Alert System for Wisconsin School for the Deaf in Delavan, Wisconsin, Press Release May 7, 2007, http://www.prweb.com/releases/2007/05/prweb523841.htm, Sep. 1, 2009.

* cited by examiner

*Primary Examiner* — Hai Phan
*Assistant Examiner* — Hongmin Fan
(74) *Attorney, Agent, or Firm* — Cohen & Grigsby, P.C.

(57) ABSTRACT

A facility emergency system. The system includes a control unit and a manual activation station in communication with the control unit, wherein the manual activation station comprises a switch. The system also includes a plurality of lights in communication with the control unit and a plurality of automatic locks in communication with the control unit, wherein the control unit includes instructions which, when executed by the control unit, cause the control unit to receive an activation signal from the manual activation station, activate the plurality of automatic locks, and activate the plurality of lights.

18 Claims, 10 Drawing Sheets

FACILITY EMERGENCY SYSTEMS AND METHODS

BACKGROUND

Places in which many people congregate or attend, such as workplace and educational facilities and institutions, far too often come under attack by weapon wielding persons and those wishing to do harm to an individual or group of individuals. When such an institution or facility is under attack or the threat of an attack, a quick response by those managing or administering the facility or institution is often the best way to minimize the impact of an attack. However, facilities and institutions often do not have an effective way to quickly respond to a threat or an attack from persons from outside or from within the facility or institution.

The problem becomes particularly troublesome when a facility or institution is an educational institution. Parents entrust that their children are safe while attending school, whether it be a public school, private school, or institution of higher learning. School administrators may have a plan to deal with a threat or an actual attack, but the plan may not facilitate a quick response or containment of a dangerous situation and may not facilitate delivery of information to emergency responders.

Thus, there is a need for systems and methods that allow for schools to quickly respond to threats and dangerous situations in order to mitigate the effects of such threats and dangerous situations. There is a further need for systems and methods that allow facility administrators, managers, or security personnel to quickly and effectively place the facility or a portion of the facility into a lockdown mode and to convey information to first responders and other emergency personnel.

SUMMARY

In various embodiments, the present invention is directed to systems and methods that allow for a fast and effective response to a threat or a dangerous situation in a facility. Various embodiments alert people both inside and outside the facility of such threat or dangerous situation and allow for the alerted people to seek a safe place or to flee the facility. Various embodiments also automatically initiate a lockdown of the entire facility or a portion of the facility. Further embodiments facilitate the transfer of information to first responders and other emergency personnel.

In various embodiments, the present invention is directed to a facility emergency system. The system includes a control unit and a manual activation station in communication with the control unit, wherein the manual activation station comprises a switch. The system also includes a plurality of lights in communication with the control unit and a plurality of automatic locks in communication with the control unit, wherein the control unit includes instructions which, when executed by the control unit, cause the control unit to receive an activation signal from the manual activation station, activate the plurality of automatic locks, and activate the plurality of lights.

In various embodiments, the present invention is directed to a method of activating an emergency lockdown procedure in a facility. The method includes receiving, via a control unit, an activation signal and activating, via the control unit, a plurality of automatic locks in response to the activation signal. The method also includes activating, via a control unit, a plurality of lights in response to the activation signal.

In various embodiments, the present invention is directed to a facility emergency system. The system includes means for receiving, via a control unit, an activation signal and means for activating, via the control unit, a plurality of automatic locks in response to the activation signal. The system also includes means for activating, via a control unit, a plurality of lights in response to the activation signal.

In various embodiments, the present invention is directed to a computer readable medium having stored thereon instructions which, when executed by a processor, cause the processor to:

receive an activation signal from a manual activation station;

activate a plurality of automatic locks; and activate a plurality of lights.

Those and other details, objects, and advantages of the present invention will become better understood or apparent from the following description and drawings showing embodiments thereof.

BRIEF DESCRIPTION OF THE DRAWINGS

The accompanying drawings illustrate examples of embodiments of the invention. In such drawings.

DESCRIPTION

Embodiments of the systems and methods of the present invention are directed to an emergency system that may be activated in the event of a threat or an emergency that is present in a facility or any type of building, structure, or outdoor place. Non-limiting examples of facilities include workplace buildings; educational institutions, public facilities, hotels, cruise ships, shopping malls, retail stores, etc.

Figure 1:
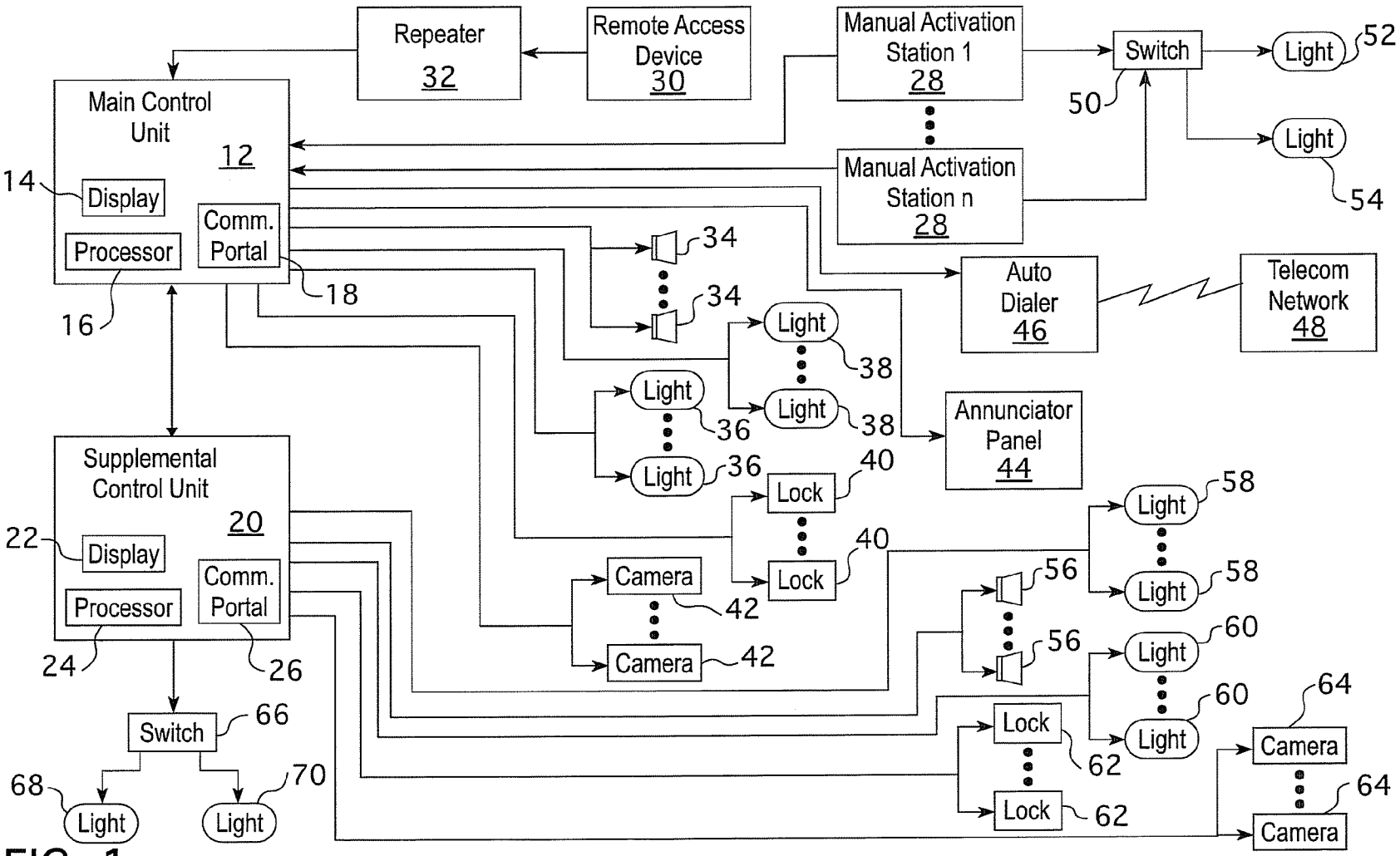
FIG. 1 illustrates an embodiment of a facility emergency management system.

FIG. 1 illustrates an embodiment of a facility emergency management system 10. The system 10 includes one or more main control units 12 that provide the decision-making capability and the ability to activate receive signals from and send activation signals to various components or peripheral devices. Although FIG. 1 illustrates the case of one main control unit 12, it can be understood that more than one main control unit 12 can be incorporated into the system 10. The main control unit 12 may include a display panel 14, a processor and associated circuitry 16, and a communications portal 18. In various embodiments, the communications portal 18 is a wireless or wireline connection that can communicate with various other components of the system 10. In various embodiments, the main control unit 12 may be located in a secure area that can only be accessed by authorized personnel. Also, the main control unit 12 may include tamper-proof features such as physical or electronic locks or other devices that limit or control access to the interior of the main control unit 12.

The system 10 may include one or more supplemental control units 20 that may be located in, for example, remote areas of the facility where the system 10 is deployed. In various embodiments, the supplemental control unit 20 is located in a building that is separate from a building in which the main control unit 12 is located. The supplemental control unit 20 may include a display panel 22, a processor and associated circuitry 24, and a communications portal 26. In embodiments where the system 10 includes one or more supplemental control units 20, the main control unit 12 and each supplemental control unit 20 may function in a master-slave arrangement. The supplemental control, unit 20 may include tamper-proof features such as physical or electronic locks or other devices that limit or control access to the interior of the supplemental control unit 20.

The main control unit 12 may receive a signal from one or more manual activation stations 28 that may be configured as, for example, pull switches or handles or any type of device that may be physically toggled or activated to trigger a signal that is sent from the manual activation stations 28 to the main control unit 12. The manual activation stations 28 may be located at various and prominent or hidden points in the facility in which the system 10 is deployed. For example, lighted manual activation stations 28 may be located in hallways or rooms of the facility and less visible manual activation stations 28 may be located in, for example, administration offices or security offices of the facility in which the system 10 is deployed. In various embodiments, the manual activation stations 28 may be in communication with one or more main control units 12 and/or with one or more supplemental control units 20.

The main control unit 12 may receive a signal from a remote activation device 30. The device 30 may be any type of wireless or wireline device that is located remote from the facility in which the system 10 is deployed and that is capable of sending an activation signal to the main control unit 12 or, in various embodiments, to the supplemental control unit 20. For example, the remote activation device 30 may located at an emergency services agency (e.g., a police department) so that the main control unit 12 can be activated in response to, for example, an emergency or 911 call to the emergency services agency. In one embodiment, the remote activation device 30 may be a compact, wireless device such as a wireless key fob. In various embodiments, the device 30 may be issued to and carried by employees or administrators of the facility in which the system 10 is deployed. The remote activation device 30 may be in communication with the main control unit 12 via a repeater 32. The repeater 32 may be, for example, a digital or analog amplifier or retransmitter.

The main control unit 12 may be in communication via, for example, wireline or wireless connections, with various output devices. One or more speakers 34 may be mounted inside or outside the facility in which the system 10 is deployed so that audible messages or alert tones may be played on the speakers 34 when an activation of the system 10 is received by the main control unit 12. Visual devices such as interior mounted lights 36 and exterior mounted lights 38 may provide a visual alert when an activation of the system 10 is received by the main control unit 12. In various embodiments, the lights 36, 38 are colored (e.g., blue) LED strobe lights. The main control unit 12 may also signal various locking devices 40 so that all or selected portions of the doors and/or windows of the facility in which the system 10 is deployed are automatically locked. The locking devices 40 may be, for example, magnetic locking devices that prohibit ingress and permit egress. In various embodiments, the locking devices 40 may be deactivated, or unlocked, using, for example, a key that is given to authorized personnel or emergency responders. The main control unit 12 may also be in communication with still or video cameras 42 that are mounted in the facility so that pictures and/or video of all or selected parts of the facility may be captured for instant display or later playback.

The main control unit 12 may be in communication via, for example, wireline or wireless connections, with an annunciator panel 44. The annunciator panel 44 may be located in, for example, administration offices or security offices of the facility in which the system 10 is deployed. The annunciator panel 44 may provide information to, for example, emergency responders, administrators or security personnel, regarding the status of the system 10. The annunciator panel 44 may also provide relevant information regarding the system 10 when the main control unit 12 receives an activation signal from one or more of the manual activation stations 28 or the remote access device 30. In one embodiment, the annunciator panel 44 provides a graphical display of the various areas of the facility in which the system 10 is deployed and lockdown initiated. In one embodiment, the annunciator panel 44 graphically illustrates the status of various zones of the facility in which the system 10 is deployed.

The main control unit 12 may be in communication via, for example, wireline or wireless connections, with an auto dialer 46. The auto dialer 46 may be configured to dial preselected telephone numbers and deliver a pre-recorded message. For example, the auto dialer 46 may be configured to dial emergency personnel, administrators or owners of the facility in which the system 10 is deployed, etc. The auto dialer 46 may be in communication with any type of telecommunications network 48 such as, for example, the public switched telephone network (PSTN), a wireless (e.g., cellular telephone) network, a voice over Internet protocol (IP) network, etc.

The system 10 may include a safe indicator switch 50 that may be toggled, for example, in a particular area (e.g., a room) in which the occupants deem themselves to be safe. When the switch 50 is triggered, one or more exterior safe indicator lights 52 and one or more interior safe indicator lights 54 may be lit to signal that the occupants of the immediate area are safe and thus emergency responders and others will know that a threat does not exist in that particular area.

The supplemental control unit 20 may be in communication via, for example, wireline or wireless connections, with various output devices in much the same way that various output devices are in communication with the main control unit 12. The devices may include one or more speakers 56, visual devices such as interior mounted lights 58 and exterior mounted lights 60. The supplemental control unit 20 may also signal various locking devices 62 and still or video cameras 64. The supplemental control unit 20 may be in communication with a safe indicator switch 66 and one or more exterior safe indicator lights 68 and one or more interior safe indicator lights 70.

In various embodiments, the manual activation stations 28 may include or have integral therewith the lights 36, 58, and the speakers 34, 56.

Figure 2:
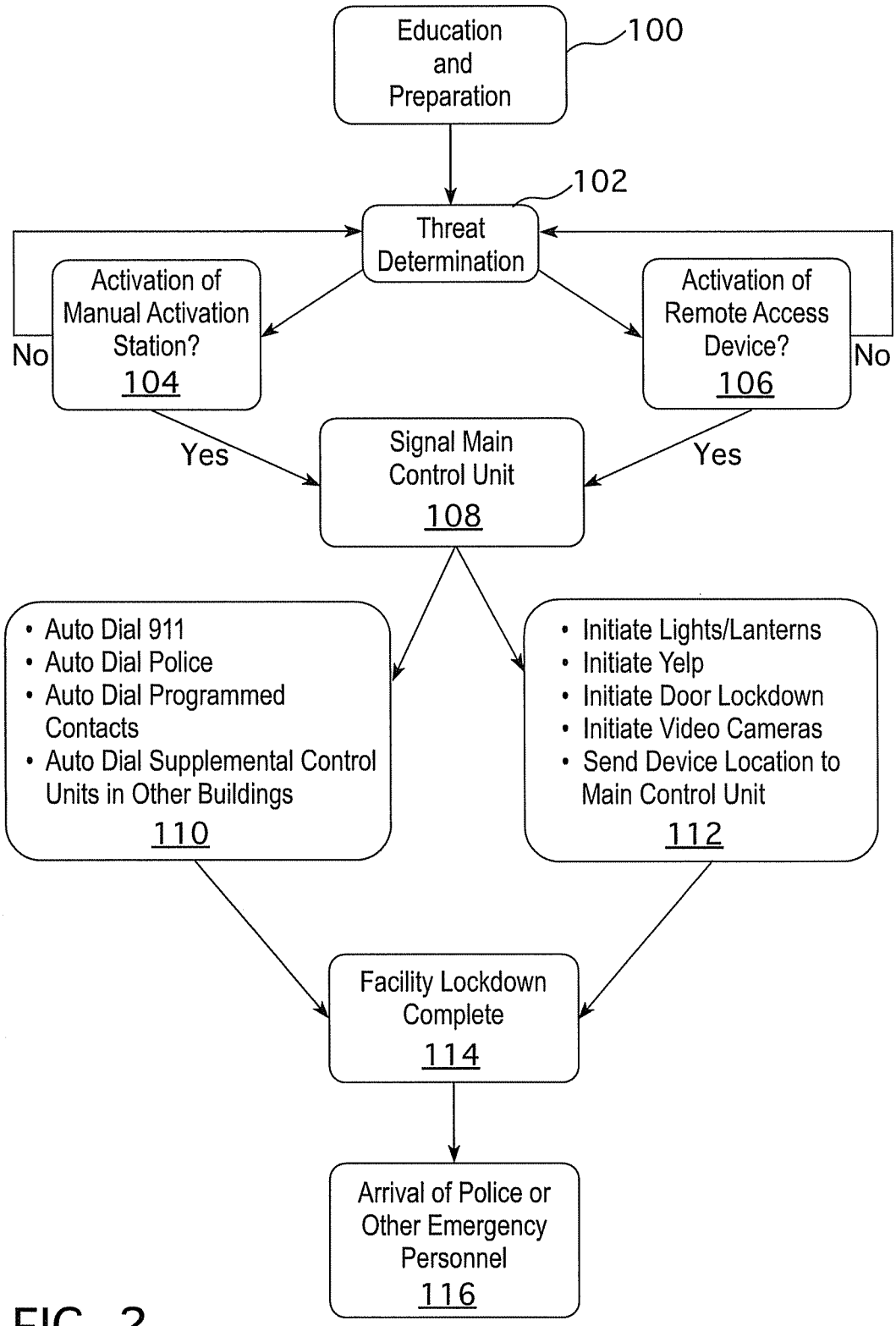
FIG. 2 illustrates an embodiment of a process performed using the facility emergency management system of FIG. 1.

FIG. 2 illustrates an embodiment of a process performed using the facility emergency management system 10 of FIG. 1. At step 100, administration and/or security personnel engage in education regarding the use of the system 10 and protocols that should be followed in the event of a threat or an emergency. At step 102, a determination is made as to whether a threat or an emergency has occurred in the facility in which the system 10 is deployed. A determination is made by the presence of an activation of at least one of the activation devices 28 at step 104 or by the presence of an activation of at least one of the remote access device 30 at step 106.

At step 108, an activation signal is sent to the main control unit 12 in the event that activation occurred at step 104 and/or step 106. At step 110, the auto dialer 46 dials predetermined telephone numbers such as, for example, 911, a police telephone number, various administration personnel, and any supplement control units 20 that are integrated with the system 10. At step 112, various devices are activated such as the lights 36, 38, 58, 60, speakers 34, 56, cameras 42, 64 and locks 40, 62. At step 114 the facility lockdown is complete and at step 116 emergency responders arrive at the facility. In one embodiment, the responding emergency personnel may view the annunciator panel 44 to determine where the emergency situation exists within the facility in which the system 10 is deployed.

Figure 3:
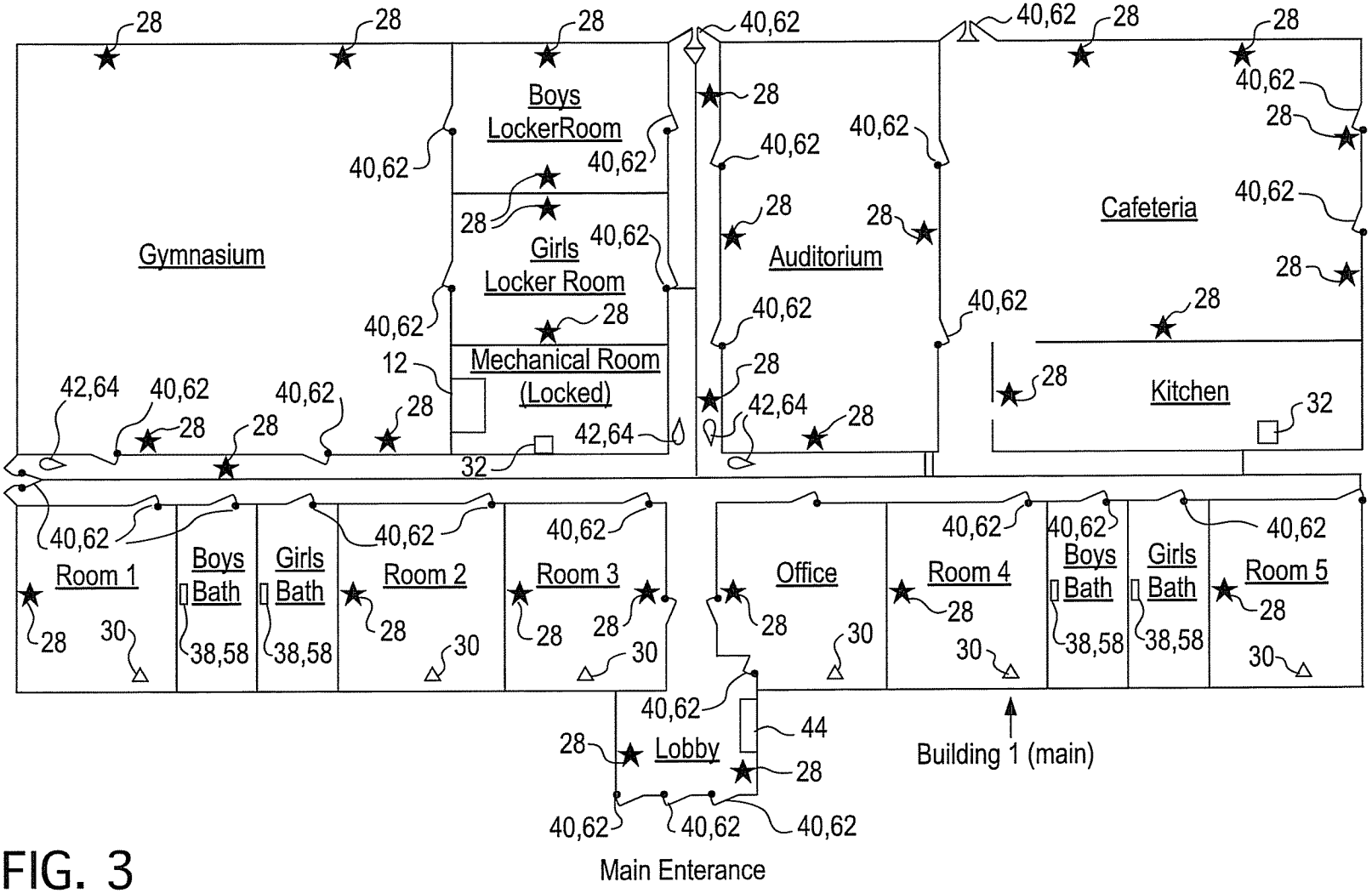
FIGS. 3 through 5 illustrate embodiments of the placement of various components of the system of FIG. 1 in an exemplary facility.
Figure 4:
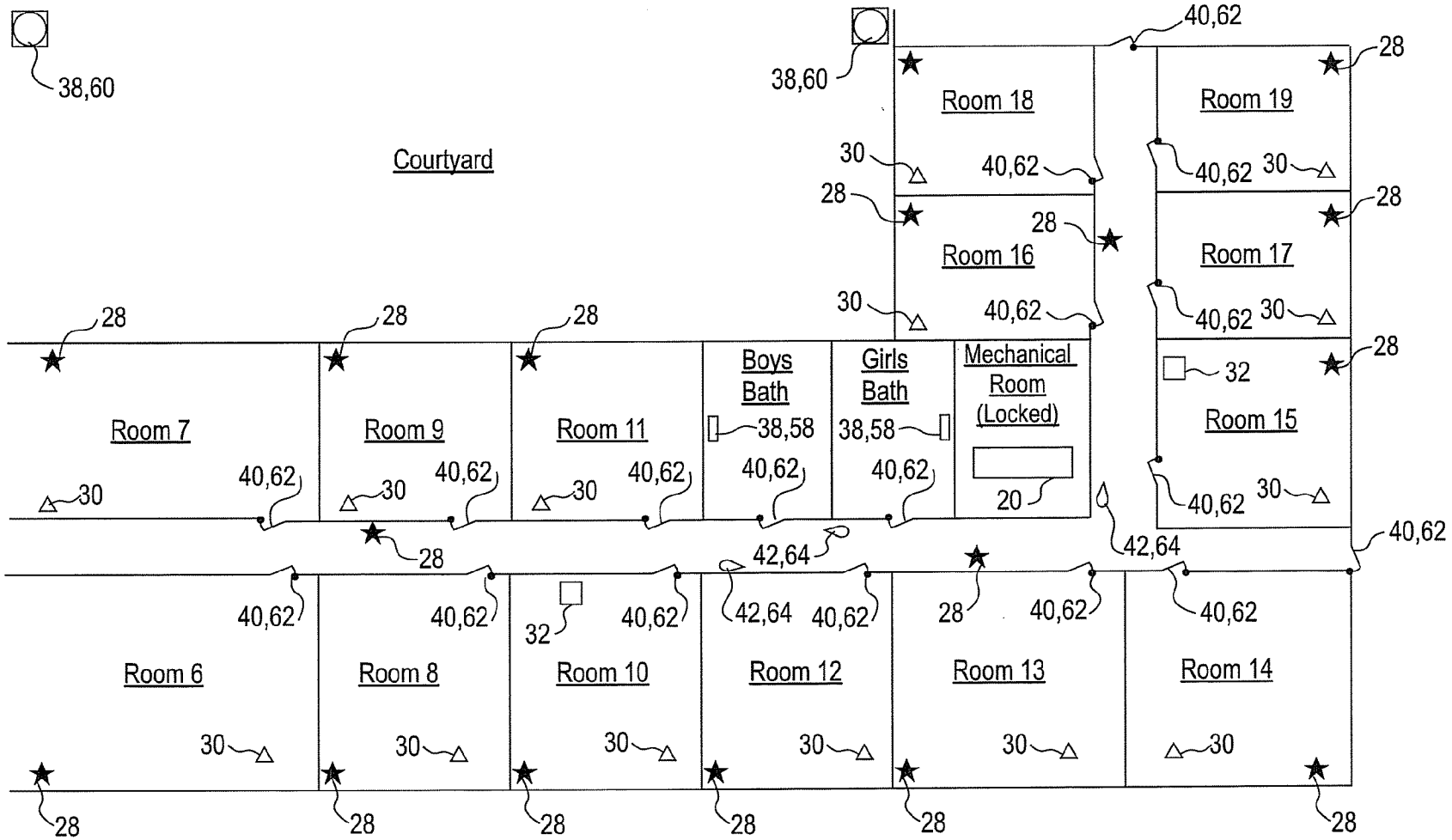
Figure 5:
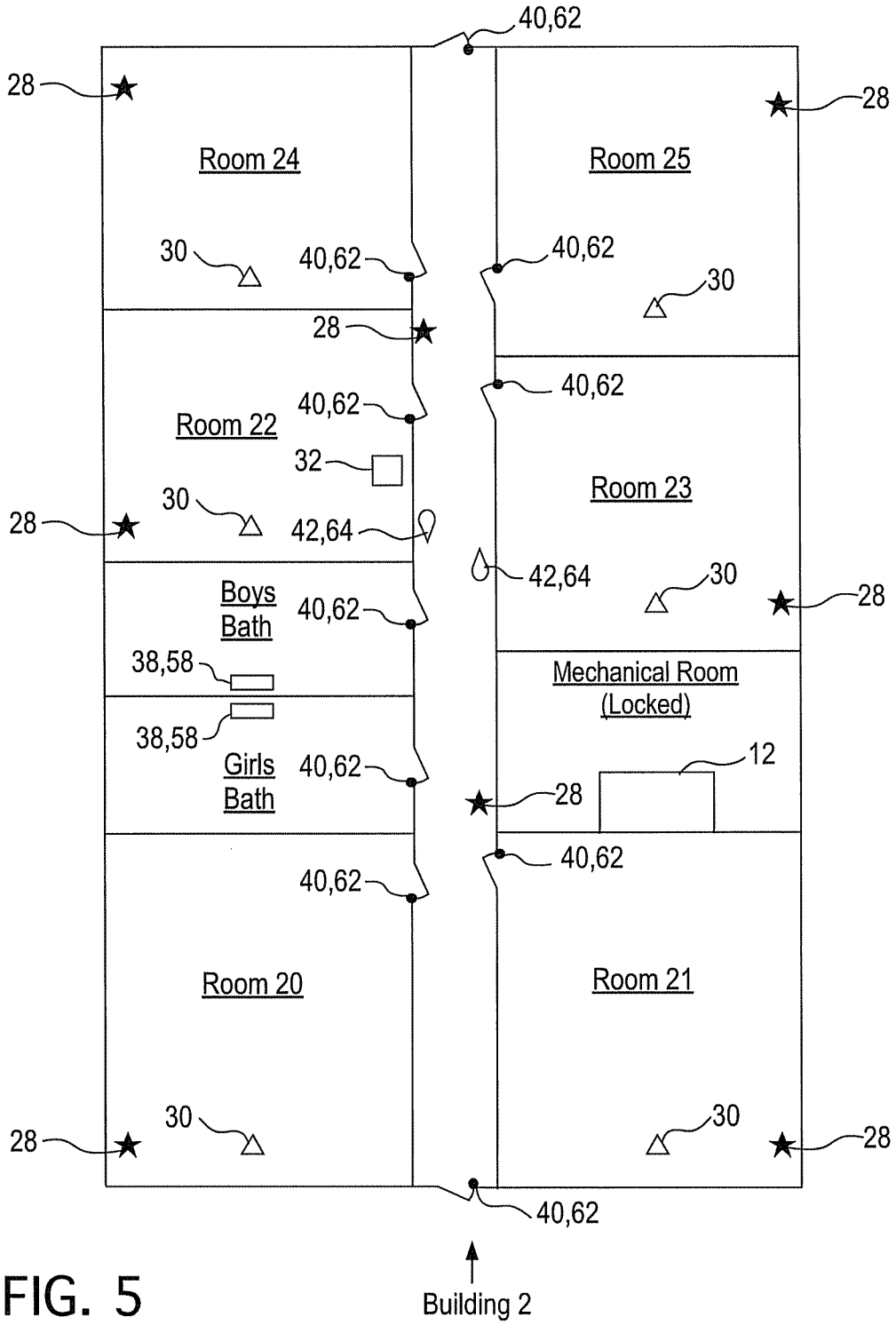

FIGS. 3 through 5 illustrate embodiments of the placement of various components of the system 10 of FIG. 1 in an exemplary facility. As shown in FIG. 3, a main control unit 12 is located in a locked mechanical room of a main building of the facility. As shown in FIG. 4, the main building also includes a supplemental control unit 20 located in a second locked mechanical room of the main building. As shown in FIG. 5, a second building of the facility includes a second main control unit 12 located in a locked mechanical room. Although the facility illustrated in FIGS. 3 through 5 is shown as a school, it can be understood that the embodiments of the system 10 described herein may be incorporated into any type of facility.

Figure 6:
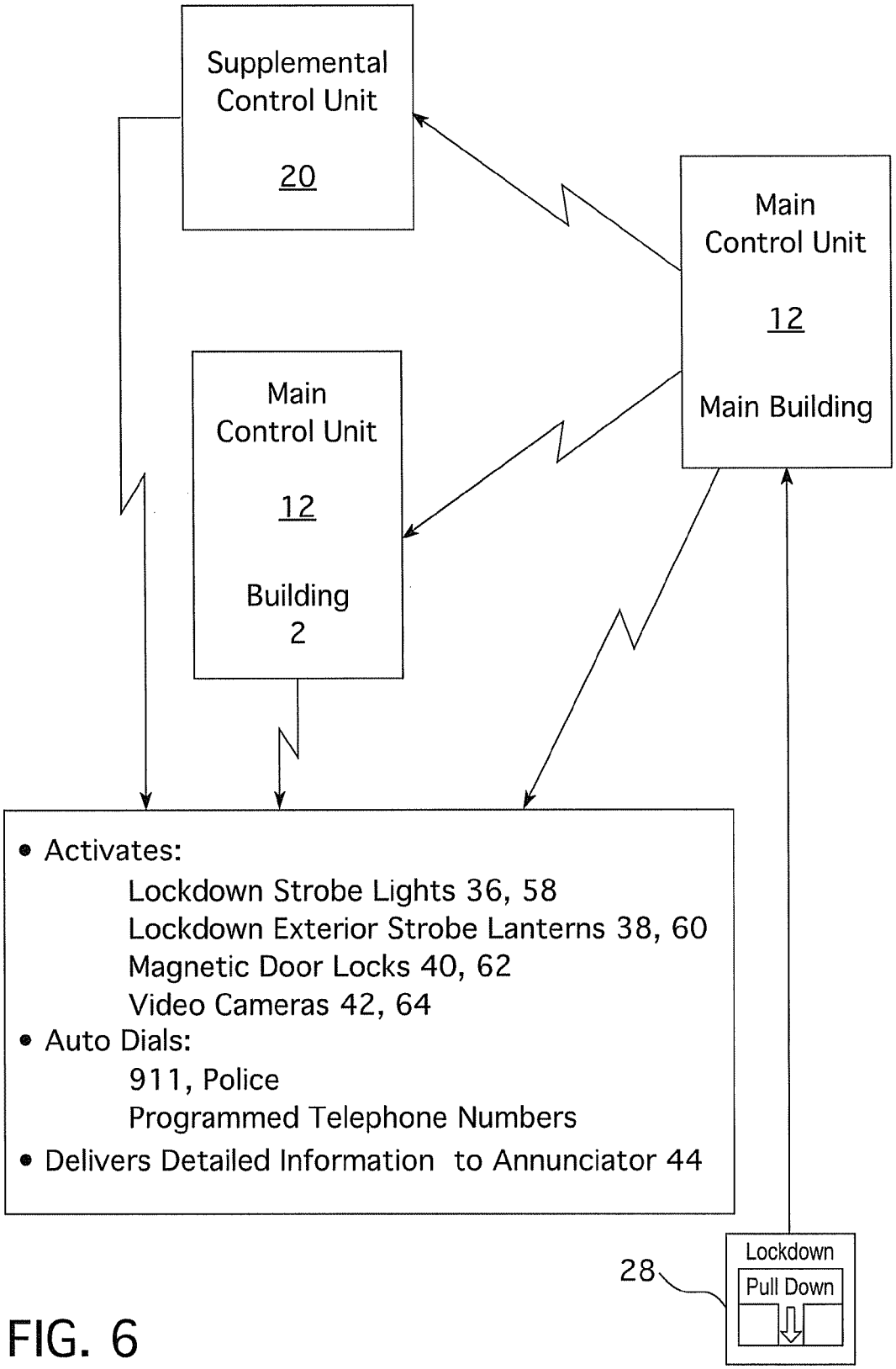
FIGS. 6 through 9 illustrate embodiments of activation scenarios using the system of FIG. 1.

FIGS. 6 through 9 illustrate embodiments of activation scenarios using the system 10 of FIG. 1. As shown in FIG. 6, when a threat is recognized the manual activation station 28 connected to a main control unit 12 located in a main building is activated and a signal is sent from the main control unit 12 in the main building to a main control unit 12 in another building and a supplemental control unit 20. The control units 12, 20 activate the lights 36, 38, 58, 60, locks 40, 62, cameras 42, 64 and activate the auto dialer 46. The control units 12, 20 also send detailed information to the annunciator panel 44. The facility is thus in a lockdown condition and the occupants of the facility await the arrival of emergency personnel.

Figure 7:
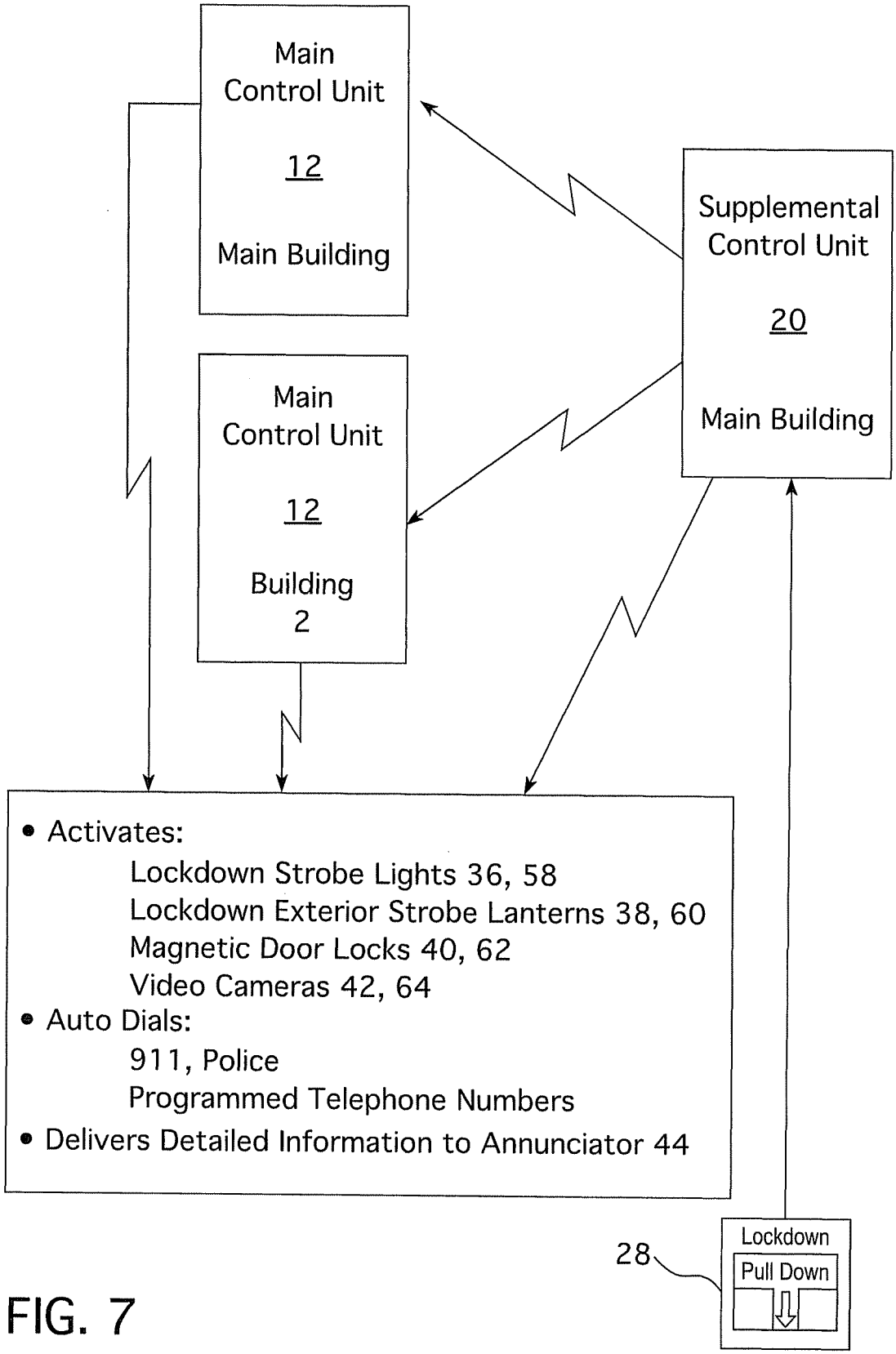

As shown in FIG. 7, when a threat is recognized the manual activation station 28 connected to the supplemental control unit 20 in a main building is activated and a signal is sent from the supplemental control unit 20 in the main building to a main control unit 12 in another building and a main control unit 12 of the main building. The control units 12, 20 activate the lights 36, 38, 58, 60, locks 40, 62, cameras 42, 64 and activate the auto dialer 46. The control units 12, 20 also send detailed information to the annunciator panel 44. The facility is thus in a lockdown condition and the occupants of the facility await the arrival of emergency personnel.

Figure 8:
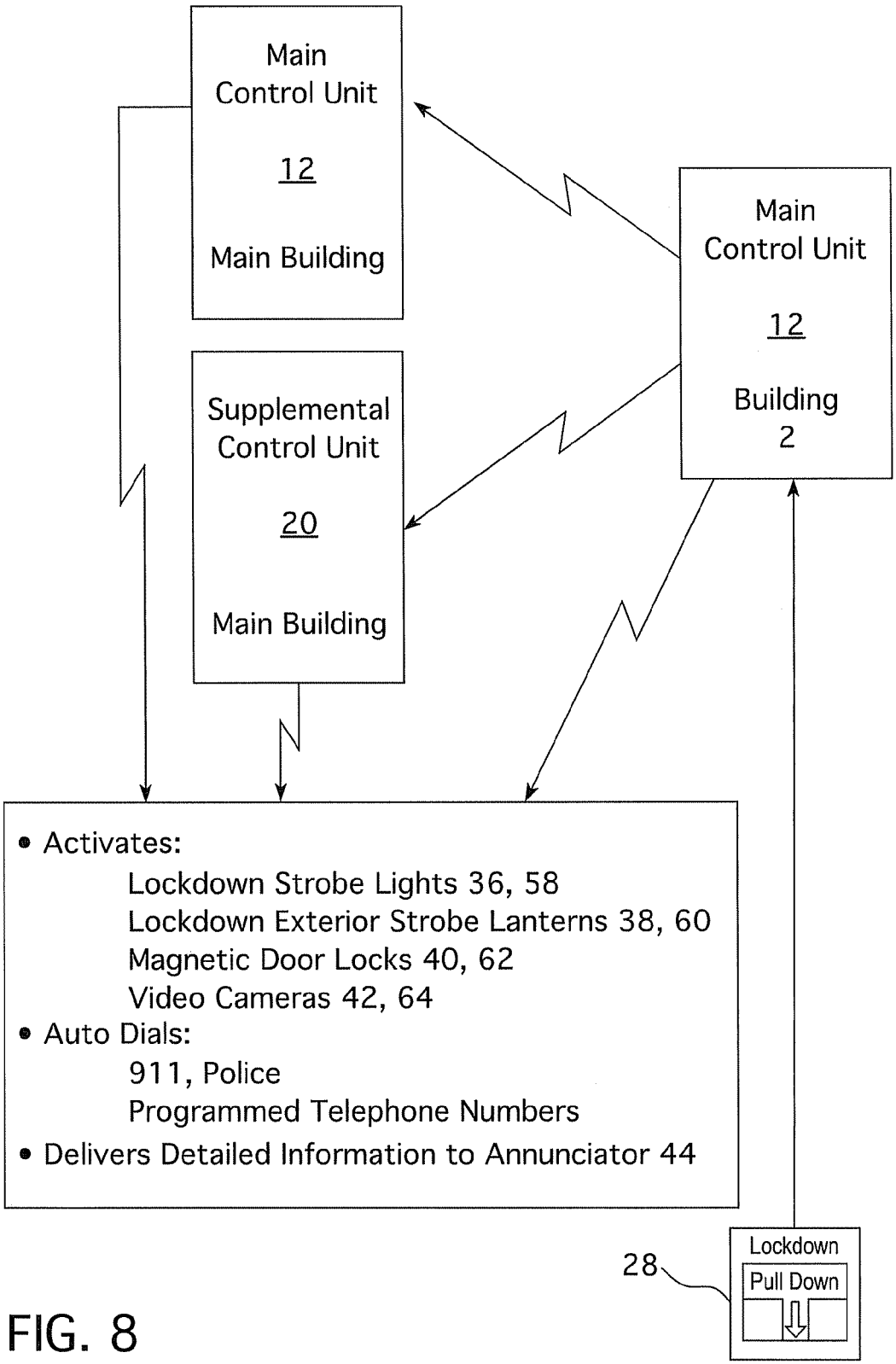

As shown in FIG. 8, when a threat is recognized the manual activation station 28 connected to the main control unit 12 in a second building is activated and a signal is sent from the main control unit 12 in the second building to a main control unit 12 in a main building and a supplemental control unit 20 of the main building. The control units 12, 20 activate the lights 36, 38, 58, 60, locks 40, 62, cameras 42, 64 and activate the auto dialer 46. The control units 12, 20 also send detailed information to the annunciator panel 44. The facility is thus in a lockdown condition and the occupants of the facility await the arrival of emergency personnel.

Figure 9:
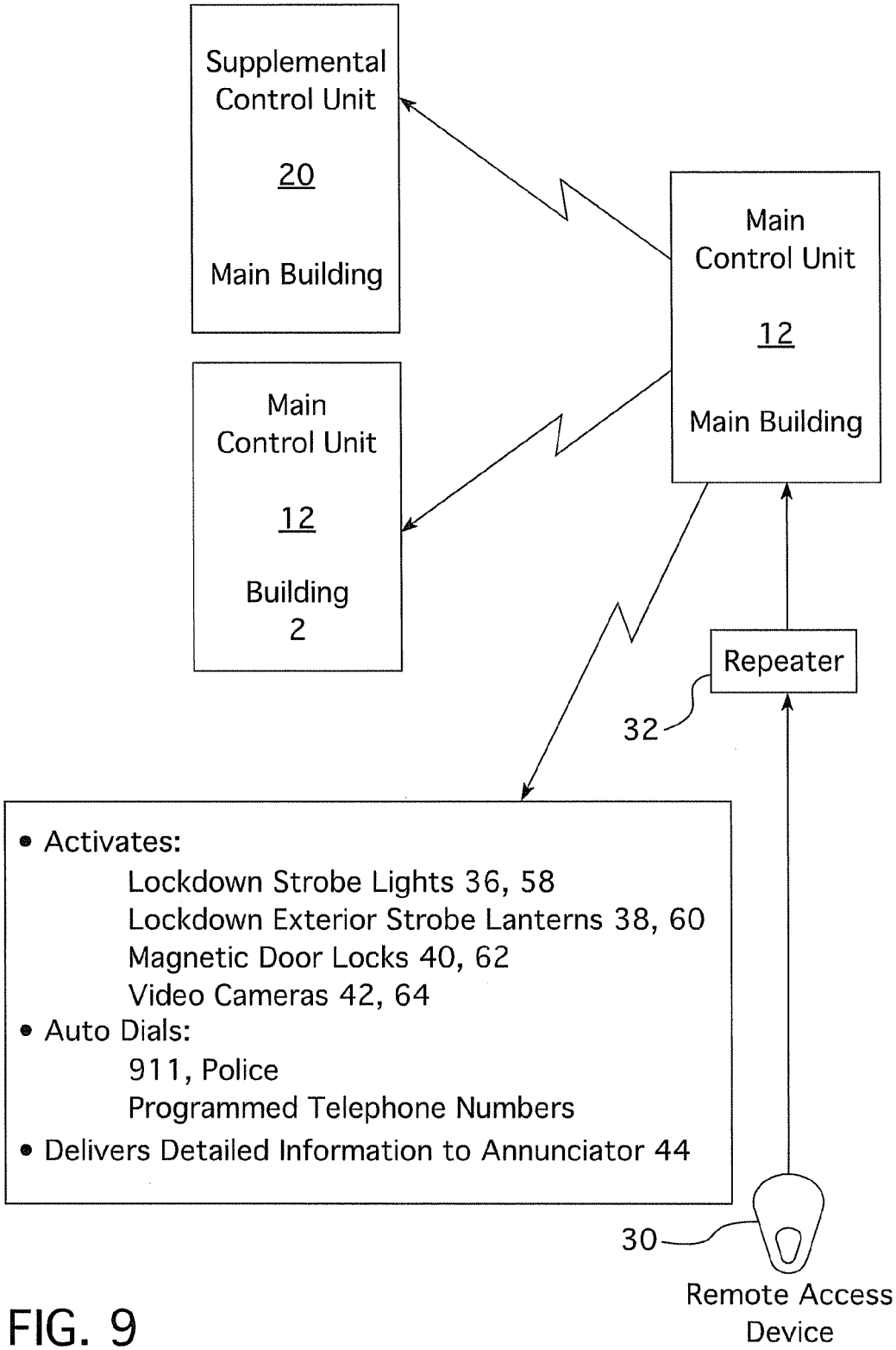

As shown in FIG. 9, when a threat is recognized the remote access device 30, via the repeater 32, activates the main control unit 12 in a main building and a signal is sent from the main control unit 12 of the main building to a main control unit 12 in a second building and a supplemental control unit 20 of the main building. The control units 12, 20 activate the lights 36, 38, 58, 60, locks 40, 62, cameras 42, 64 and activate the auto dialer 46. The control units 12, 20 also send detailed information to the annunciator panel 44. The facility is thus in a lockdown condition and the occupants of the facility await the arrival of emergency personnel.

Figure 10:
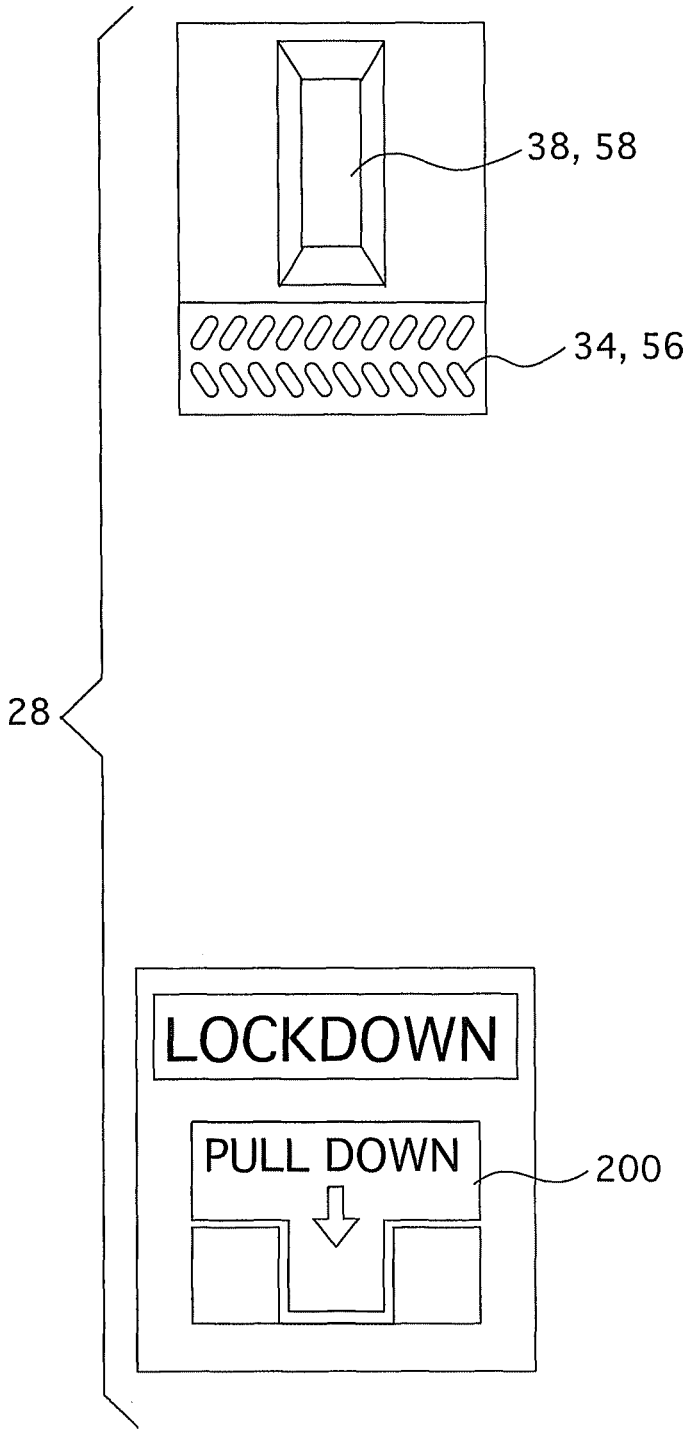
FIG. 10 illustrates an embodiment of manual activation stations that can be incorporated into the system of FIG. 1.

FIG. 10 illustrates an embodiment of the manual activation station 28 that can be incorporated into the system 10 of FIG. 1. As shown in FIG. 10, the manual activation station 28 may include interior lights 38, 58 that may, for example, flash when the station 28 is activated. The manual activation station 28 may also include speakers 34, 56 that provide audible sounds or messages. The manual activation station 28 may also be configured with a pulldown lever 200 that is physically pulled in order to activate the manual activation station 28. The manual activation station 28 may also be lit such that in dark conditions or in the event of a power loss (i.e., the system 10 is operating on a backup power source), a person may readily locate the manual activation station 28 if needed. As shown in FIG. 10, the lever 200 may be located in a relatively lower position of a wall and the lights 38, 58 and the speakers 34, 56 may be located on a relatively higher position of the wall.

In various embodiments, the control units 12, 20 may include an emergency battery backup and may provide power to the various peripheral devices that are in communication with the control units 12, 20. In various embodiments, the lights 36, 38, 58, 60 are color coded according to the location of the facility in which the lights 36, 38, 58, 60 are present or are activated.

An exemplary use of the system 10 according to various embodiments of the present invention is illustrated below. The example is for the system 10 installed in a school facility. In the example, school is in session and a teacher observes an individual with a weapon outside the facility and near a classroom window. The teacher either activates a nearby manual activation station 28 or instructs a student to activate the manual activation station 28. The main control unit 12 sends the appropriate signal to any of the supplemental control units 20 and the lights 36, 38, 58, 60 may be lit and messages or audible alert tones may be broadcast over the speakers 34, 56. The cameras 42, 64 are also instructed to begin recording and the locks 40, 62 are activated to initiate a lockdown of the facility.

In the classroom, all students take cover and silently conceal themselves by the teacher's desk. The teacher verifies that the classroom door is locked and then takes cover with the students. The teacher may activate a switch 50, 66 to indicate that all occupants of the classroom are safe and the teacher may contact, for example, administrative personnel using an in classroom telephone. The students and teachers then wait for additional instructions from administrators or emergency responders, are escorted from the facility by emergency responders, or prepare for an immediate life saving escape from the facility.

For those students and teachers outside of the school buildings, the students and teachers immediately evacuate to a predesignated safe meeting place (e.g., a point across the street from the school building, a nearby business, a nearby cemetery, etc.).

Various embodiments of the present invention allow for the identification of threats or dangerous situations and provide instantaneous alerts to multiple persons of the threat or dangerous situation. For example, various embodiments of the present invention allow for complete system activation instantaneously. In various embodiments, the system offers alerts as visual cues that do not intimidate or shock persons in the vicinity. Various embodiments also provide for a comprehensive warning of an emergency or threat throughout a facility (whether single or multifloor and single or multi-building) with activation of one device. Various embodiments provide for alerts that are activated outside of a facility and provide an identification of precisely where activation of the system occurred. Various embodiments automatically initiate a proper and predefined emergency protocol while being able to be integrated into the existing framework of a facility.

Various embodiments of the present invention may be implemented using computer-readable media. The terms "computer-readable medium" and "computer-readable media" in the plural as used herein may include, for example, magnetic and optical memory devices such as diskettes, compact discs of both read-only and writeable varieties, optical disk drives, hard disk drives, etc. A computer-readable medium may also include memory storage that can be physical, virtual, permanent, temporary, semi-permanent and/or semi-temporary. A computer-readable medium may further include one or more data signals transmitted on one or more carrier waves.

While several embodiments of the invention have been described, it should be apparent that various modifications, alterations and adaptations to those embodiments may occur to persons skilled in the art with the attainment of some or all of the advantages of the present invention. It is therefore intended to cover all such modifications, alterations and adaptations without departing from the scope and spirit of the present invention.

What is claimed is:

1. A facility emergency system, the system comprising:
a control unit;
a manual activation station in communication with the control unit, wherein the manual activation station comprises a switch;
a plurality of lights in communication with the control unit;
a plurality of automatic locks in communication with the control unit; and
wherein the control unit includes instructions which, when executed by the control unit, cause the control unit to:
receive an activation signal from the manual activation station;
activate the plurality of automatic locks;
activate the plurality of lights; and
a safe indicator switch in communication with the control unit.

2. The system of claim 1, further comprising a second control unit in communication with the control unit.

3. The system of claim 1, further comprising a plurality of cameras in communication with the control unit.

4. The system of claim 1, further comprising a plurality of speakers in communication with the control unit.

5. The system of claim 1, further comprising an annunciator panel in communication with the control unit.

6. The system of claim 1, further comprising a remote activation device.

7. The system of claim 6, wherein the remote activation device comprises a key fob device.

8. The system of claim 1, further comprising an auto dialer in communication with the control unit.

9. The system of claim 1, wherein the manual activation station further comprises a speaker and a light.

10. A facility emergency system, the system comprising:
a control unit;
a manual activation station in communication with the control unit, wherein the manual activation station comprises a switch;
a plurality of lights in communication with the control unit;
a plurality of automatic locks in communication with the control unit; and
wherein the control unit includes instructions which, when executed by the control unit, cause the control unit to:
receive an activation signal from the manual activation station;
activate the plurality of automatic locks;
activate the plurality lights; and
a safe indicator light that is in communication with the control unit.

11. The system of claim 10, further comprising a second control unit in communication with the control unit.

12. The system of claim 10, further comprising a plurality of cameras in communication with the control unit.

13. The system of claim 10, further comprising a plurality of speakers in communication with the control unit.

14. The system of claim 10, further comprising an annunciator panel in communication with the control unit.

15. The system of claim 10, further comprising a remote activation device.

16. The system of claim 15, wherein the remote activation device comprises a key fob device.

17. The system of claim 10, further comprising an auto dialer in communication with the control unit.

18. The system of claim 10, wherein the manual activation station further comprises a speaker and a light.

* * * * *